US005723939A

United States Patent [19]

Okuno et al.

[11] Patent Number: 5,723,939

[45] Date of Patent: Mar. 3, 1998

[54] CIRCULAR FLUORESCENT LAMP

[75] Inventors: Ikuhiro Okuno, Kyoto; Toshiyoshi Oga, Shiga; Hidehito Kawahara, Osaka; Masashi Sangen, Kyoto, all of Japan

[73] Assignee: Matsushita Electronics Corporation, Osaka, Japan

[21] Appl. No.: 575,995

[22] Filed: Dec. 21, 1995

[30] Foreign Application Priority Data

Dec. 28, 1994 [JP] Japan ..... 6-327809
Dec. 28, 1994 [JP] Japan ..... 6-327810

[51] Int. Cl.[6] ..... H01T 63/02

[52] U.S. Cl. ..... 313/493; 313/1

[58] Field of Search ..... 313/493, 634, 313/1; 220/7.1 R; 362/216, 260

[56] References Cited

U.S. PATENT DOCUMENTS

| | | | |
|---|---|---|---|
| 2,309,676 | 2/1943 | Schmidling | 313/493 |
| 4,121,132 | 10/1978 | Repsher | 313/493 |
| 4,833,574 | 5/1989 | Gallagher | 313/493 |
| 5,034,655 | 7/1991 | Mirayama et al. | 313/493 |
| 5,105,118 | 4/1992 | Shinada et al. | 313/634 |

FOREIGN PATENT DOCUMENTS

| | | |
|---|---|---|
| Des.57-20104 | 5/1982 | Japan . |
| 58-112238 | 7/1983 | Japan . |
| 2-61956 | 3/1990 | Japan . |
| 6-203798 | 7/1994 | Japan . |
| 2 137 017 | 9/1984 | United Kingdom . |

*Primary Examiner*—Ashok Patel
*Assistant Examiner*—Joseph Williams
*Attorney, Agent, or Firm*—Merchant, Gould, Smith, Edell, Walter & Schmidt, P.A.

[57] ABSTRACT

This invention provides a compact, efficient and well-designed circular fluorescent lamp with high output power. The circular fluorescent lamp has less non-luminant region and good characteristics of luminous intensity distribution, and keeps high level of lamp lumen output. Circular arc tubes are disposed concentrically on the same plane. Electrodes are attached to the tube-end parts of the one side of the circular arc tubes respectively, and the other tube-end parts of non-electrode side are sealed. The circular arc tubes are joined each other near the tube-end parts of the non-electrode side with a bridge-jointed portion, so that a discharge path is formed between the electrodes inside the arc tubes. The tube outer diameter of the circular arc tubes is 14 mm, the circle outer diameter of the outer circular arc tube is 150 mm, and the circle inner diameter of the inner arc tube is 90 mm. The distance measured along the center line of the tube from the point corresponding radially to the end part of the bridge-jointed portion to the sealed tube-end part of the outer circular arc tube is 11 mm, and the distance measured along the center line of the tube from the point corresponding radially to the end part of the bridge-jointed portion to the sealed tube-end part of the inner circular arc tube is 6 mm.

32 Claims, 18 Drawing Sheets

CIRCULAR FLUORESCENT LAMP

FIELD OF THE INVENTION

This invention relates to a circular fluorescent lamp wherein plural circular arc tubes are concentrically disposed.

BACKGROUND OF THE INVENTION

Circular fluorescent lamps have been commonly used, mainly for residential lightings. In order to obtain higher output power, at least two circular fluoresent lamps are disposed unevenly for a specialized lighting equipment. Such lighting equipments would become thicker and bigger, so it is not economical. Another problem is that the designing of the appliances will be limited. In another case, a circular fluorescent lamp is used and the output of the lamp is as high as the sum of the above-mentioned plural circular fluorescent lamps. However, the circular fluorescent lamp and the equipment become bigger, and economical and design problems will also occur.

In order to solve these problems of the conventional circular fluorescent lamps, Published Unexamined (Kokai) Japanese Patent Application No. Hei 2-61956, and No. Hei 6-203798 disclose circular fluorescent lamps respectively. Such circular fluorescent lamps are manufactured by disposing two compact glass circular arc tubes 21 and 22 concentrically on the same plane, joining the tubes with a glass tube bridge-jointed portion 23 and forming a discharging path inside the tubes (see FIG. 25). In the FIG. 25, numbers 24 and 25 indicate electrodes. Several examinations were carried out with these fluorescent lamps. It was found that in these circular fluorescent lamps, the area of a non-luminous portion including an electrode mounting part around the circumference, namely a distance K in FIG. 25, would be increased compared to that of the conventional circular fluorescent lamps. Even if a lamp base is formed, the characteristics of luminous intensity distribution around the circumference of the lamp will be deteriorated. And a larger base will cause problems in designing. The lamp has a compact configuration and is lighted up with a relatively heavy load. Thus the coldest temperature inside the arc tube, which determines the mercury vapor pressure, rises over the optimum range of 40°–50° C. As a result, the lamp lumen output becomes lower than the maximum value as a fluorescent lamp. In addition, the lamp lumen output will be deteriorated when the area of the non-luminous portion is increased.

SUMMARY OF THE INVENTION

In order to solve the above-mentioned problems of conventional techniques, this invention provides a compact, efficient and well-designed circular fluorescent lamp with high output power. The circular fluorescent lamp of this invention also has less non-luminous area and good characteristics of luminous intensity distribution, and keeps a high level of lamp lumen output around the lamp circumference.

In order to achieve the purposes, a first circular fluorescent lamp of this invention has plural circular arc tubes disposed concentrically, and each of the tubes has an electrode at one tube-end part and a sealed portion at the other tube-end part. The tubes are joined near the sealed portion with a bridge-jointed portion, and thus a discharge path is formed inside the tubes. When the distance $L_1$(mm) is measured along the center line of the tube from the point corresponding radially to the end part of the bridge-jointed portion to the sealed tube-end part of the outer circular arc tube, and the distance $L_2$(mm) is measured along the center line of the tube from the point corresponding radially to the end part of the bridge-jointed portion to the sealed tube-end part of the inner circular arc tube, $L_1$ is longer than $L_2$.

It is preferable in this circular fluorescent lamp that the plural circular arc tubes are disposed on the same plane.

It is also preferable that $L_1 \geqq 1.3L_2$ holds true.

It is also preferable that the tube-end part of the electrode side of the outer circular arc tube is longer than that of the inner circular arc tube.

It is also preferable that the configuration of the tips of the bridge-jointed portions are essentially symmetric to the center axis of the circular arc tubes.

It is also preferable that holding parts for a bending process are provided at the outer surfaces of the both tube-end parts of the circular arc tubes. Preferably in this case, grooves are formed on at least the inner surfaces of the tips of the non-electrode side.

It is also preferable that a lamp base is provided to surround the tube-end parts of the electrode side of the circular arc tubes.

It is also preferable that a lamp base is provided to surround the both tube-end parts of the circular arc tubes while the tube-end part of the non-electrode side of the outer arc tube is exposed to the open air. Preferably in this case, a thermal shielding part is provided with the lamp base in order to shield the heat between the tube-end parts of the electrode side and the tube-end parts of the non-electrode side.

It is also preferable that the tube-end parts of the non-electrode side of the circular arc tubes are sealed with stems.

According to a second embodiment, a circular fluorescent lamp of this invention has plural circular arc tubes disposed concentrically, and each of the tubes has an electrode at one tube-end part, and a sealed portion at the other tube-end part. The tubes are joined near the sealed portions with a bridge-jointed portion to form one discharge path inside the tubes, and a coldest spot is formed at the other tube-end part of the non-electrode side. When the distance L(mm) is measured along the center line of the tube from the point corresponding radially to the end part of the bridge-jointed portion to the sealed tube-end part, and the tube outer diameter of the arc tube is d(mm), $0.5d \leqq L \leqq 1.3d$ holds true.

It is preferable in this second embodiment that the plural arc tubes are disposed on the same plane.

It is also preferable that holding parts for a bending process are provided at the outer surfaces of the both tube-end parts of the circular luminous tubes. Preferably in this case, grooves are formed at least at the inner surfaces of the tips of the non-electrode side.

It is also preferable that the non-electrode tube-end parts of the circular arc tubes are sealed with stems.

According to a third embodiment, a circular fluorescent lamp of this invention has plural arc tubes disposed concentrically, and each of the tubes has an electrode at one tube-end part and a sealed portion at the other tube-end part. The tubes are joined near the sealed portion with a bridge-jointed portion to form one discharge path inside the tubes, and a coldest spot is formed at the tube-end part of the non-electrode side. And the circular fluorescent lamp is provided with a lamp base which surrounds at least one side of the both tube-end parts, and the coldest spot is exposed to the open air.

It is preferable in the third embodiment that the plural circular arc tubes are disposed on the same plane.

It is also preferable that when the distance L(mm) is measured along the center line of the tube from the point corresponding radially to the end part of the bridge-jointed portion to the sealed tube-end part and the tube outer diameter of the circular arc tube is d(mm), $0.5d \leqq L \leqq 1.3d$ holds true.

It is also preferable that the lamp base is separated from the coldest spot of the non-electrode side.

It is also preferable that the lamp base surrounds the tube-end parts of the electrode side and the coldest spot of the other tube-end part, and that a vent is provided to the lamp base so that the coldest spot is exposed to the open air.

It is also preferable that the coldest spot is formed at the outer circular arc tube.

It is also preferable that holding parts for a bending process are provided at the outer surfaces of the both end parts of the circular arc tubes. Preferably in this case, grooves are formed on the inner surfaces of the tips of the non-electrode side.

It is also preferable that the end parts of the non-electrode side are sealed with stems.

According to a fourth embodiment, a circular fluorescent lamp of this invention has plural circular arc tubes disposed concentrically, and each of the tube has an electrode at one tube-end part and a sealed portion of the other tube-end part. The tubes are joined near the tube-end parts of the non-electrode side with a bridge-jointed portion to form a discharge path inside the tubes, while a coldest spot is formed at the tube-end part of the non-electrode part and a lamp base is provided to surround at least one side of the both tube-end parts. And a thermal shielding part is provided to the lamp base in order to shield the heat between the tube-end parts of the electrode side and those of the non-electrode side.

It is preferable in the fourth embodiment that the plural circular arc tubes are disposed on the same plane.

It is also preferable that when the distance L(mm) is measured along the center line of the tube from the point corresponding radially to the end part of the bridge-jointed portion to the sealed tube-end part and the tube outer diameter of the circular arc tube is d(mm), $0.5d \leqq L \leqq 1.3d$ holds true.

It is also preferable that a lamp base is provided to surround the tube-end parts of the electrode side and the coldest spot of the other tube-end part, and a vent is formed on the lamp base so that the coldest spot is exposed to the open air.

It is also preferable that holding parts for a bending process are provided at the outer surfaces of the both end parts of the circular arc tubes. Preferably in this case, grooves are formed at least at the inner surfaces of the tips of the non-electrode side.

It is also preferable that the tube-end parts of the non-electrode side of the circular arc tubes are sealed with stems.

According to the first embodiment, the circular fluorescent lamp has plural arc tubes disposed concentrically, and each of the tubes has an electrode at one end part and a sealed portion of the other tube-end part. The tubes are joined near the tube-end parts of the non-electrode side to form a discharge path inside the tubes with the bridge-jointed portion. When the distance $L_1$(mm) is measured along the center line of the tube from the point corresponding radially to the end part of the bridge-jointed portion to the sealed tube-end part of the outer circular arc tube and the distance $L_2$(mm) is measured along the center line of the tube from the point corresponding radially to the end part of the bridge-jointed portion to the sealed tube-end part of the inner circular arc tube, $L_1$ is longer than $L_2$. Therefore, a coldest spot is formed on the end part of the non-electrode side of the outer circular arc tube. In addition, the temperature can be easily controlled to provide the best mercury vapor pressure which is corresponding to the maximum value of the lamp lumen output.

And according to the preferable example of the first embodiment in which the plural circular arc tubes are disposed on the same plane, the lighting equipment can be thinner.

According to the preferable example of the first embodiment in which $L_1 \geqq 1.3L_2$ holds true, a coldest spot to provide the best mercury vapor pressure can be accurately formed at the tip of the bridge-jointed portion side of the outer circular arc tube.

According to the preferable example of the first embodiment in which the tube-end part of the electrode side of the outer circular arc tube is longer than that of the inner circular arc tube, the effective luminous length becomes longer and as a result, lamp lumen output can be increased. In addition, if the effective luminous length of the circular arc tube is longer, the non-luminous area of the circular fluorescent lamp becomes smaller. Therefore, the characteristics of the luminous intensity distribution can be improved and a compact and well-designed circular fluorescent lamp can be provided.

According to the preferable example of the first embodiment in which the configurations of the tips of the bridge-jointed portion side are essentially symmetric to the center axis of the circular arc tube, the strength of the tip of the bridge-jointed portion side will not be lowered.

According to the preferable example of the first embodiment in which holding parts for a bending process are provided at the outer surfaces of the both tube-end parts of the circular arc tubes, the holding parts for a bending process of the circular arc tubes can be held securely while manufacturing a lamp. Therefore, the bending accuracy of the circular arc tubes can be improved. In addition, according to the preferable example in which grooves are formed at least at the inner surfaces of the tips of the non-electrode side, the coldest spots are formed in the grooves to keep the temperature at the best level.

According to the preferable example of the first embodiment in which a lamp base is provided to surround the tube-end parts of the electrode side of the circular arc tubes, the heat of the electrodes is not transferred to the other tube-end parts of the non-electrode side, so the temperature of the coldest spot does not rise excessively from the best temperature region, and therefore, the lamp lumen output is not lowered.

According to the preferable example of the first embodiment in which a lamp base is provided to surround the both tube-end parts of the circular arc tubes and those of the non-electrode side, and the tube-end part of the outer circular arc is exposed to the open air, the plural circular arc tubes can be securely held. In addition, the temperature of the coldest spot does not excessively rise. As a result, the lamp lumen output will not be lowered. And according to the preferable example in which a thermal shielding part is provided in order to shield the heat between the tube-end parts of the electrode side and those of the non-electrode side, transference of heat from the electrodes to the tube-end parts of the other side where the coldest spot is formed can be controlled. As a result, it is possible to prevent the excessive rise of the temperature of the coldest spot more securely, so the lamp lumen output will not be lowered.

According to the preferable example of the first embodiment of this invention, in which the tube-end parts of the non-electrode side of the circular arc tubes are sealed with stems, the strength of the tube-end parts of the non-electrode sides is improved compared to that of the conventional tubes. Conventionally, tube-end parts are formed by partially melting arc tubes. If the diameter of the arc tube is large, the tube-end parts of the non-electrode side become thin. On the other hand, the tube-end parts can be securely sealed by stems and also, inconvenience like cracking of the tube-end parts will be prevented during the tube bending process and after the lamp is completed. In addition, the process of manufacturing by sealing with stems is simple compared to that of the prior art, and thus the arc tubes of this invention can be manufactured using the conventional facilities.

The circular fluorescent lamp of the second embodiment of this invention has plural circular arc tubes disposed concentrically, and each of the tubes has an electrode at one tube-end part and a sealed portion of the other tube-end. And the tubes are joined near the other tube-end parts with the bridge-jointed portion to form a discharge path inside the tubes while coldest spots are formed at the tube-end parts of the non-electrode parts. When the distance L(mm) is measured along the center line of the tube from the point corresponding radially to the end part of the bridge-jointed portion to the sealed tube-end part and the outer diameter of the circular arc tube is d(mm), $0.5d \leqq L \leqq 1.3d$ holds true. Therefore, the temperature of the coldest spots can be kept in the region where the mercury vapor pressure in the arc tube is the best, and the maximum value of the lamp lumen output can be easily obtained.

The circular fluorescent lamp of the third embodiment of this invention has plural circular arc tubes disposed concentrically, and each of the tubes has an electrode at one tube-end part and a sealed portion at the other tube-end part. And the tubes are joined near the tube-end parts of the non-electrode side with the bridge-jointed portion to form a path inside the tubes, while coldest spots are formed at the other tube-end parts. In addition, a lamp base is provided to surround the tube-end parts of the electrode side and/or those of the non-electrode side, and the coldest spots are exposed to the open air. The structure prevents the heat transference from the electrodes to the side of the bridge-jointed portion, and therefore, the temperature of the coldest spot does not rise excessively from the best temperature region. As a result, the lamp lumen output will not be lowered.

According to the preferable example of the third embodiment in which the lamp base is provided separated from the coldest spots in the non-electrode side, the coldest spots can be exposed to the open air.

According to the preferable example of the third embodiment in which the lamp base is provided to surround the tube-end parts of the electrode side and the coldest spots of the other side, and a vent is formed on the lamp base so that the coldest spots are exposed to the open air, the coldest spots can be exposed to the open air while the plural circular arc tubes are held securely.

According to the preferable example of the third embodiment in which a coldest spot is formed on the outer circular arc tube, the non-luminous area of the tube-end parts of the tubes becomes smaller, and a higher lumen output value can be obtained.

The circular fluorescent lamp of the fourth embodiment of this invention has plural circular arc tubes disposed concentrically, and each of the tubes has an electrode at one tube-end part and a sealed portion of the other tube-end part. And the tubes are joined near the tube-end parts of the non-electrode side with the bridge-jointed portion to form a discharge path inside the tubes, while coldest spots are formed at the other tube-end parts. In addition, a lamp base is provided to surround the tube-end parts of the electrode side and/or those of the non-electrode side, and thermal shielding parts are provided for the lamp base to reduce the heat transference between the tube-end parts of the electrode side and those of the non-electrode side, so that heat transference from the electrodes to the coldest spot can be controlled. As a result, it is possible to prevent the temperature of the coldest spots from rising excessively from the best temperature region, and the lamp lumen output will not be lowered.

DETAILED DESCRIPTION OF THE INVENTION

This invention will be explained in detail with reference to the attached figures and the following examples.

EXAMPLE 1

Figure 1:
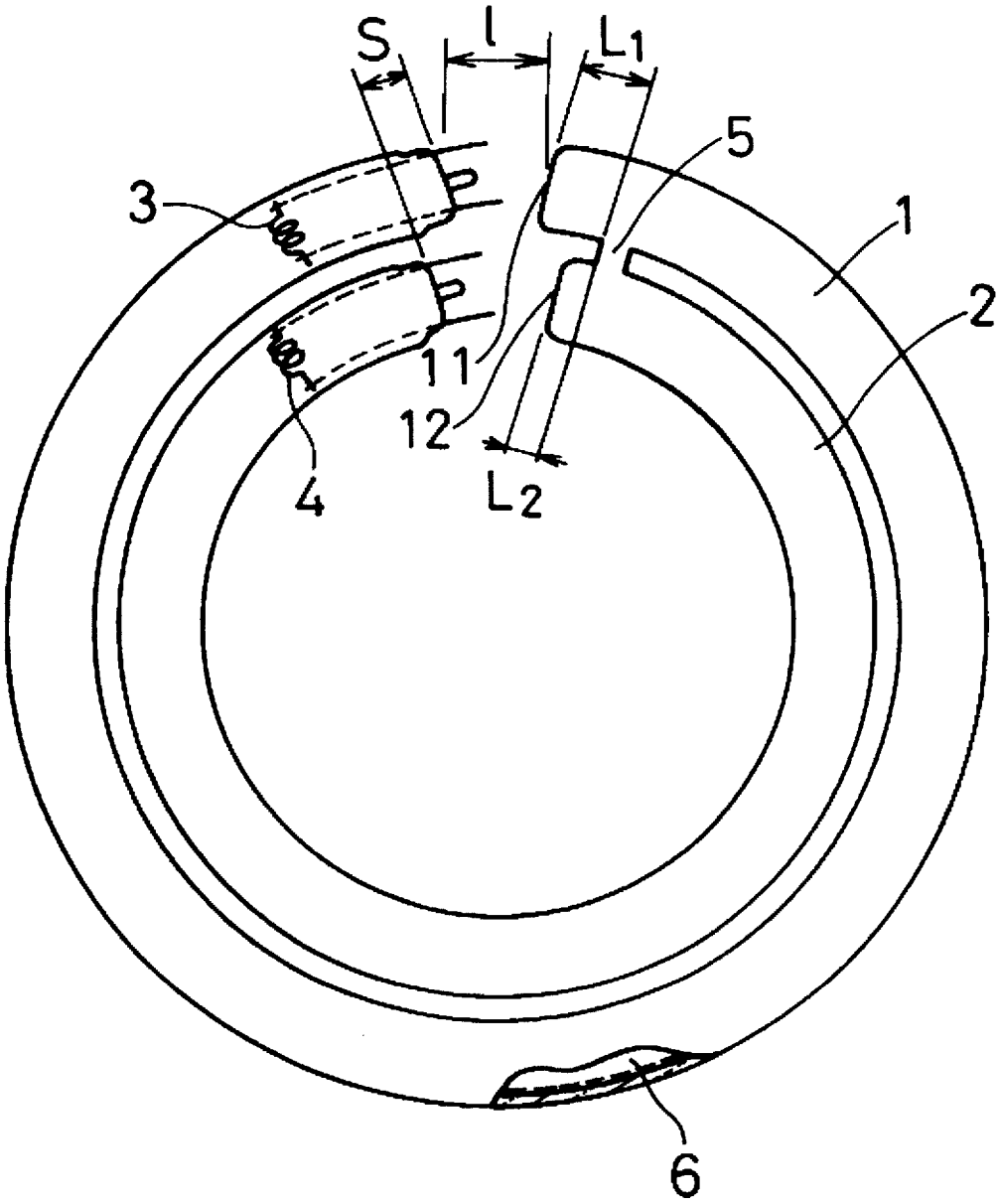
FIG. 1 is a partially cutaway view in elevation of the circular fluorescent lamp of Example 1 of this invention.
Figure 2:
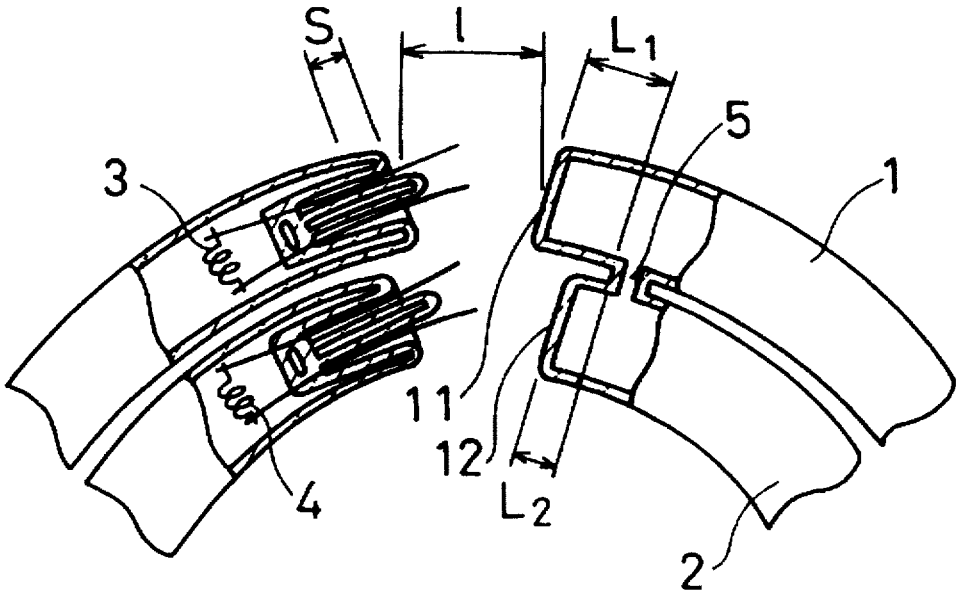
FIG. 2 is a partially cutaway view in elevation to show the structure around the bridge-jointed portion of the circular fluorescent lamp of FIG. 1.

FIG. 1 is a partially cutaway view in elevation of the circular fluorescent lamp of Example 1 of this invention, and FIG. 2 is a partially cutaway view in elevation to show the structure around the bridge-jointed portion of the circular fluorescent lamp of FIG. 1. As shown in these figures, the two glass circular arc tubes (1, 2) are disposed concentrically on the same plane, and at the tube-end parts of the circular arc tubes (1, 2) electrodes (3, 4) are respectively attached. Each of the other tube-end parts (11, 12) of the tubes (1, 2) is sealed. The parts adjacent to the tube-end parts (11, 12) are joined with a glass tube, namely, bridge-jointed portion 5, so that a discharge path is formed between the electrodes (3, 4) inside the luminant tubes. The inner surfaces of the circular arc tubes (1, 2) are coated with rare earth fluorophor 6, and mercury and rare gas (200–500 Pa) for starting and buffering, e.g., argon and neon, are sealed in the tubes. The mercury can be an amalgam alloy like zinc-mercury.

The circular fluorescent lamp of this invention has a compact shape, in which the tube outer diameter of the circular arc tubes (1, 2) is 14 mm, the circle outer diameter of the outer circular arc tube 1 is 150 mm, and the circle inner diameter of the inner arc tube 2 is 90 mm. The lamp is designed to light on at 25 W of lamp power input.

$L_1$ is the distance measured along the center line of the tube from the point corresponding radially to the end part of the bridge-jointed portion 5 to the sealed tube-end part 11 of the outer circular arc tube 1, and $L_2$ is the distance measured along the center line of the tube from the point corresponding radially to the end part of the bridge-jointed portion 5 to the sealed tube-end part 12 of the inner circular arc tube 2. $L_1$ is 11 mm and $L_2$ is 6 mm. The distance between the centers of the both ends of the outer circular arc tube 1, which is represented as 1, is 18 mm. When the circular fluorescent lamp was lighted up at 25 W using an inverter circuit of 50 kHz, a high lumen output value, namely 1620 lm, with a luminous color of 3000 kelvin of color temperature, was obtained. Temperatures of the circular arc tubes (1, 2) were measured and it was found that a coldest spot was formed on the tube-end part 11 of the outer circular arc tube 1, and the temperature of the coldest spot was 45° C. This corresponds to the best mercury vapor pressure in which almost the maximum lumen output value can be obtained when 25 W is lighted up (when the room temperature is 25° C.).

Figure 25:
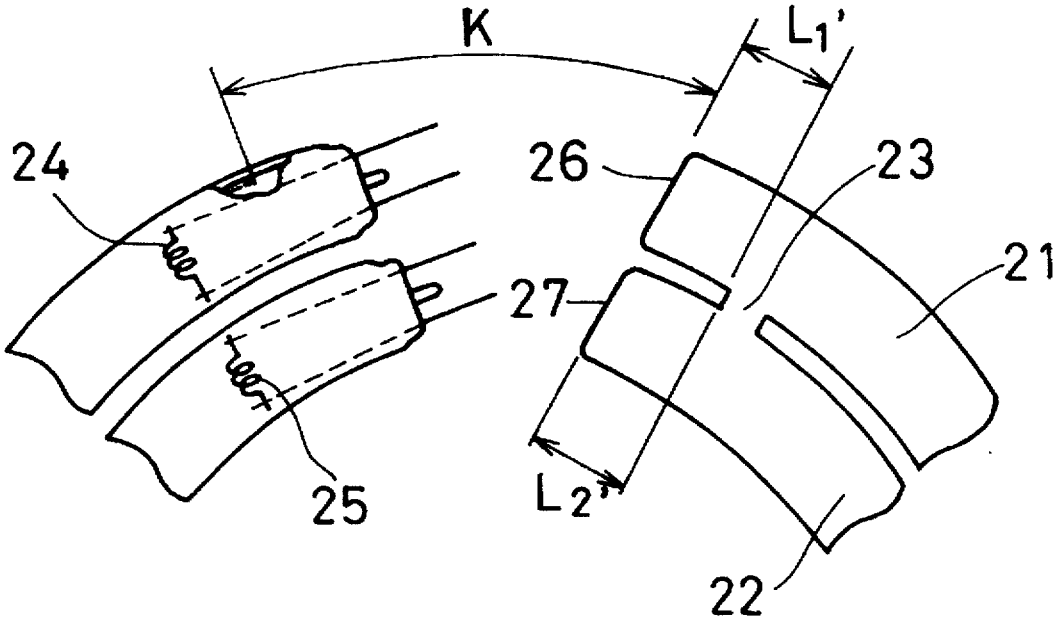
FIG. 25 (PRIOR ART)
FIG. 25 is a partially cutaway view in elevation of a conventional circular fluorescent lamp.

FIG. 25 shows a conventional circular fluorescent lamp that was manufactured to measure characteristics of a lamp. $L_1'$ is the distance measured along the center line of the tube from the point corresponding radially to the end part of the bridge-jointed portion 23 to the sealed tube-end part 26 of the outer circular arc tube 21, and $L_2'$ is the distance measured along the center line of the tube from the point corresponding radially to the end part of the bridge-jointed portion 23 to the sealed tube-end part 27 of the inner circular arc tube 22. The value of $L_1'$ is equal to that of $L_2'$. According to this lamp, the distance for $L_1'$ and $L_2'$, that of the temperature of the coldest spots of the tips in the best region was 13 mm. This lamp was lighted up at 25 W using an inverter circuit of 50 kHz as mentioned above, and the lamp lumen output was 1490 lm. In other words, the circular fluorescent lamp of this invention (FIGS. 1 and 2) had a higher lumen output value than that of the conventional circular fluorescent lamp shown in FIG. 25, and the difference was 130 lm (about 9%). Such a high value was obtained since the distance $L_1$ was longer than the distance $L_2$. Thus a coldest spot was formed at the tube-end part 11 of the non-electrode side of the outer circular arc tube 1, and the temperature was easily controlled to be the best mercury vapor pressure which corresponded to the maximum value of the lamp lumen output. And compared to the prior art of FIG. 25, the circular fluorescent lamp of this invention had less area which did not luminesce. Therefore, the characteristic of the luminous intensity distribution along the circular circumference was improved, and the improvement also contributed to the design of the lamp.

Figure 3:
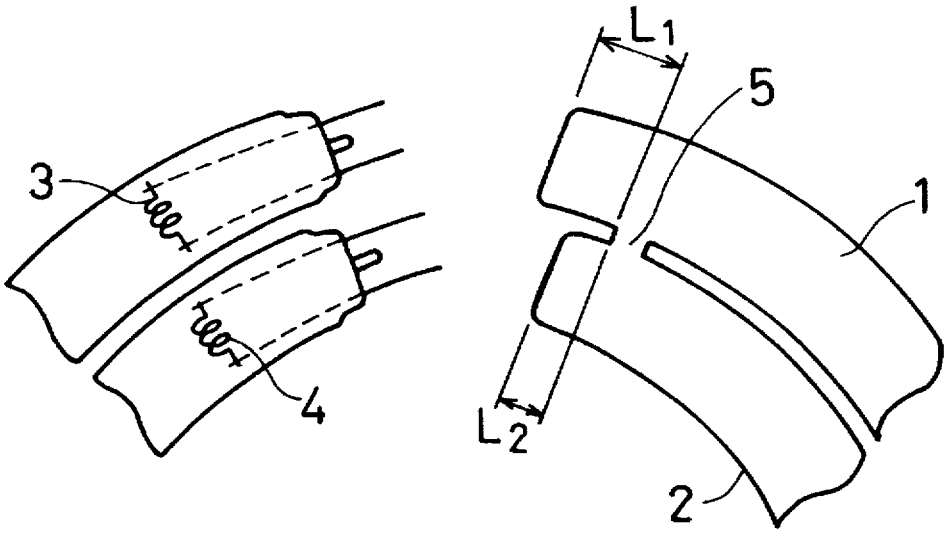
FIG. 3 is an elevational view to show the structure around a circular fluorescent lamp manufactured to be compared with that of Example 1.

As shown in FIGS. 1 and 2, the electrode tube-end part of the outer circular arc tube 1 is displaced to be longer than that of the inner circular arc tube 2. In other words, the difference between the length of the tubes is represented as S. For reference, another lamp was manufactured to measure the characteristics of the lamps. FIG. 3 shows a lamp in which an electrode 3 of the circular arc tube 1 and another electrode 4 of the circular arc tube 2 were disposed in parallel. When the lamp was lighted up at 25 W of lamp input power using an inverter circuit of 50 kHz, the lamp lumen output was 1580 lm. In other words, the circular fluorescent lamp of this invention had longer effective luminous light and the lumen output value became higher, and the difference was 40 lm (3%). In this case, too, the non-luminescing area became smaller and the characteristic of luminous intensity is improved, and the improvement clearly contributes to the design of the lamp.

Figure 4:
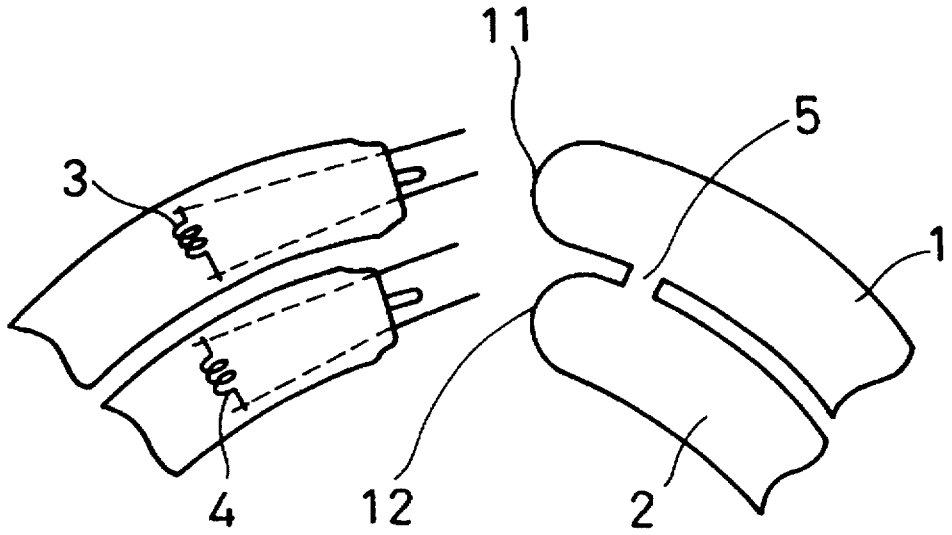
FIG. 4 is an elevational view to show another structure around the bridge-jointed portion of the circular fluorescent lamp of Example 1 of this invention.
Figure 5:
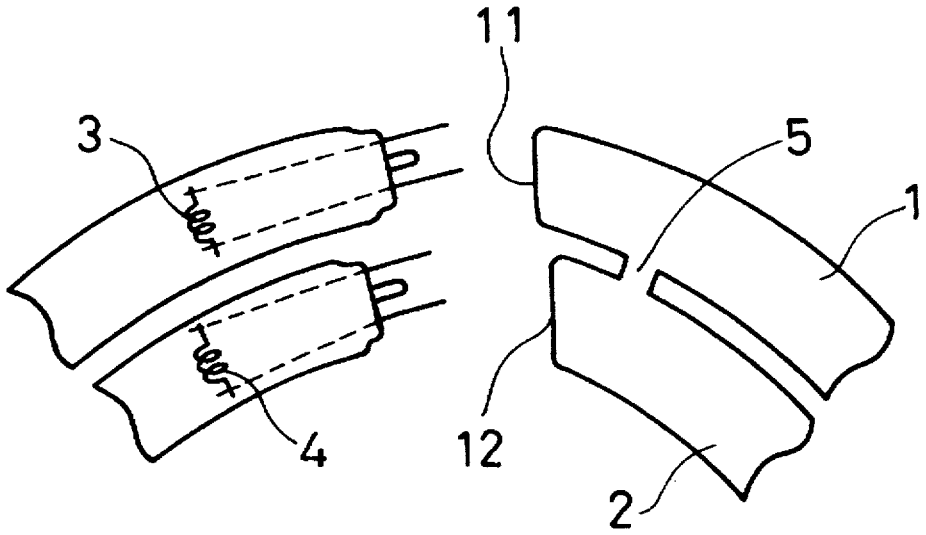
FIG. 5 is an elevational view to show the structure around the bridge-jointed portion of a circular fluorescent lamp manufactured in Example 1 to be compared with that shown in FIG. 4.

The tube-end parts (11, 12) of the bridge-jointed portion 5 of the circular arc tubes (1, 2) can be projected as shown in FIG. 4. The shape of the tube-end parts (11, 12) of the tube (1, 2) should not be asymmetric to the center axis of the tube as shown in FIG. 5, since the strength of the glass tip is significantly lowered. In any event, a tip of the tube should be processed to be symmetric to the center axis of the tube.

EXAMPLE 2

In this example, a compact circular fluorescent lamp with 60 W of lamp input was manufactured. The structure of the lamp was basically the same as that of Example 1 (FIGS. 1 and 2). The tube outer diameter of the circular arc tubes (1, 2) was 20 mm, the circle outer diameter of the outer circular arc tube 1 was 240 mm, the circle inner diameter of the inner circular arc tube 2 was 155 mm, the distance $L_1$ measured along the center line of the tube from the point corresponding radially to the end part of the bridge-jointed portion 5 to the sealed tube-end part 11 of the outer circular arc tube 1 was 17 mm, the distance $L_2$ measured along the center line of the tube from the point corresponding radially to the end part of the bridge-jointed portion 5 to the sealed tube-end part 12 of the inner circular arc tube 2 was 10 mm, and the center distance 1 of the both ends of the circular arc tube 1 was 22 mm. When the lamp was lighted up at 60 W of lamp input using an inverter circuit of 50 kHz, a high lumen output value (4530 lm) was obtained.

Related to the lamps of Examples 1 and 2, the lumen output values were further measured, especially varying the distance $L_1$. When the maximum lumen output value was obtained, $0.5d \leqq L_1 \leqq 3d$ holds, where d was the tube outer diameter of the circular arc tubes (1, 2). And it was found out that the relation between $L_1$ and $L_2$ should be $L_1 \geqq 1.3L_2$ so that a coldest spot to provide the best mercury vapor pressure is securely formed on the tube-end 11 of the outer circular arc tube 1.

EXAMPLE 3

This example refers to a circular fluorescent lamp which has the same structure of the lamps shown in Examples 1 and 2, except that a lamp base is attached.

Figure 6:
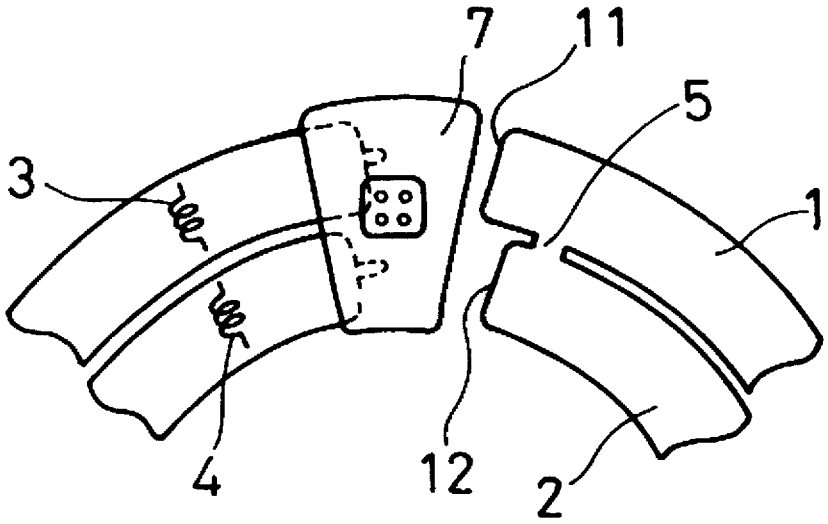
FIG. 6 is an elevational view to show a structure around the bridge-jointed portion of the circular fluorescent lamp of Example 3 of this invention.
Figure 7:
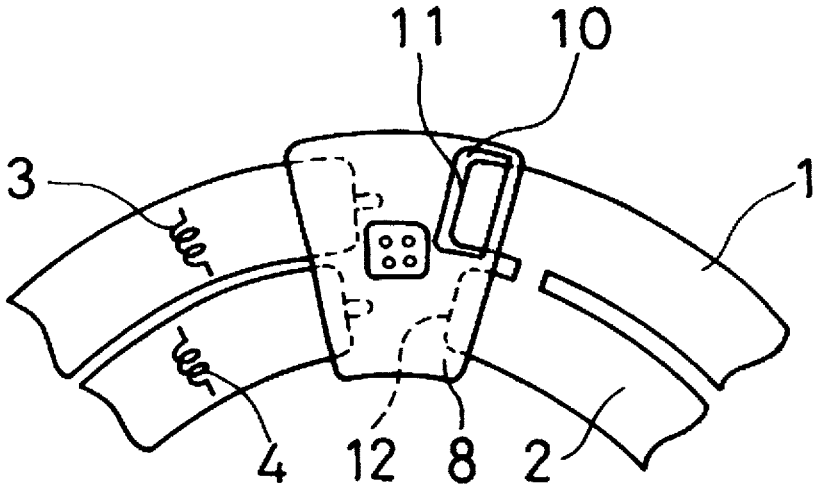
FIG. 7 is an elevational view to show another structure around the bridge-jointed portion of the circular fluorescent lamp of Example 3 of this invention.

FIG. 6 is an elevational view to show a structure around the bridge-jointed portion of the circular fluorescent lamp of Example 3 of this invention, and FIG. 7 is an elevational view to show another structure around the bridge-jointed portion of the circular fluorescent lamp of Example 3 of this invention. FIG. 6 shows a circular fluorescent lamp in which the tube-end parts of the circular arc tubes 1 and 2 (electrodes 3, 4 side) are surrounded with a lamp base 7. The tube-end parts 11 and 12 are separated from the lamp base 7 and exposed to the open air. On the other hand, FIG. 7 shows a circular fluorescent lamp in which tube-end parts in the electrodes (3, 4) side and the other tube-ends (11, 12) are surrounded with a lamp base 8. In this case, a vent 10 is provided for the lamp base 8 so that the tube-end part (the coldest spot) of the outer circular arc tube 1 is exposed to the open air. As mentioned above, the lamp bases 7 and 8 are attached while the tube-end part of the non-electrode side (the coldest spot) 11 of the outer circular arc tube 1 is exposed to the open air. The heat of the electrodes 3 and 4 will not be transferred to the tube-end part 11, so the temperature of the coldest spot does not excessively rise. Therefore, the lamp lumen output will not be lowered. Especially, when the lamp base 8 is attached to surround both of the tube-end parts of the electrodes (3, 4) side and the other tube-end parts (11, 12), the circular arc tubes 1 and 2 can be stable and well-kept.

Figure 8:
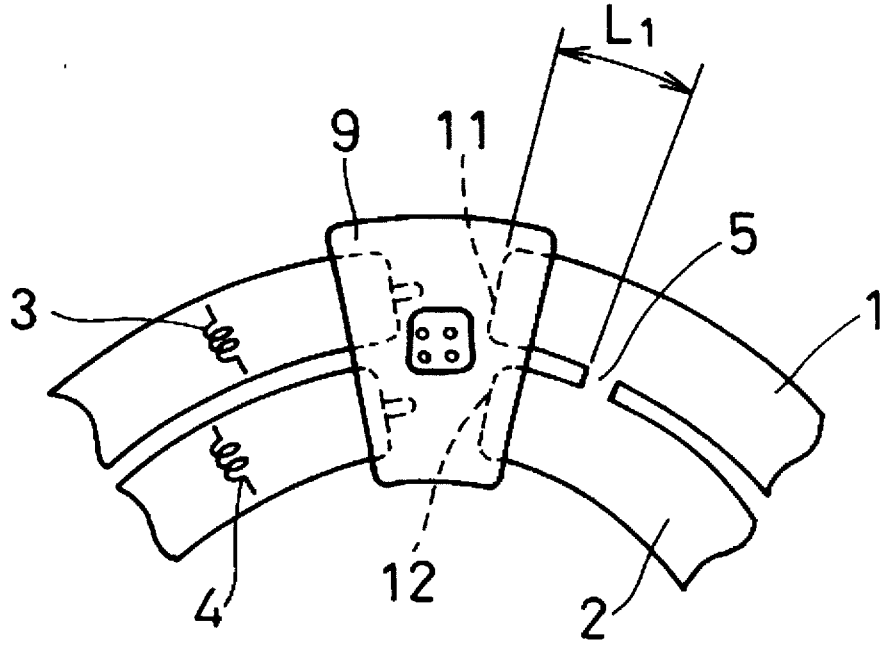
FIG. 8 is an elevational view to show the structure around the bridge-jointed portion of a circular fluorescent lamp manufactured as a comparative example to the lamps shown in FIGS. 6 and 7 in Example 3 of this invention.

In FIG. 8, a lamp base 9 is not formed with a vent, thus the tube-end part (the coldest spot) 11 of the outer circular arc tube 1 is not exposed to the open air. When this lamp base 9 is used to surround the both tube-end parts of the circular arc tubes 1 and 2, $L_1$ should be longer than those of Examples 1 and 2 in order to prevent the excessive temperature increase of the coldest spot at the tips of the tube-end part when a lamp is completed. As a result, the effective luminous length of a lamp with the lamp base 9 in FIG. 8 becomes shorter than those of lamp bases 7 and 8 in FIGS. 6 and 7, and the lamp lumen output is lowered.

EXAMPLE 4

Figure 9:
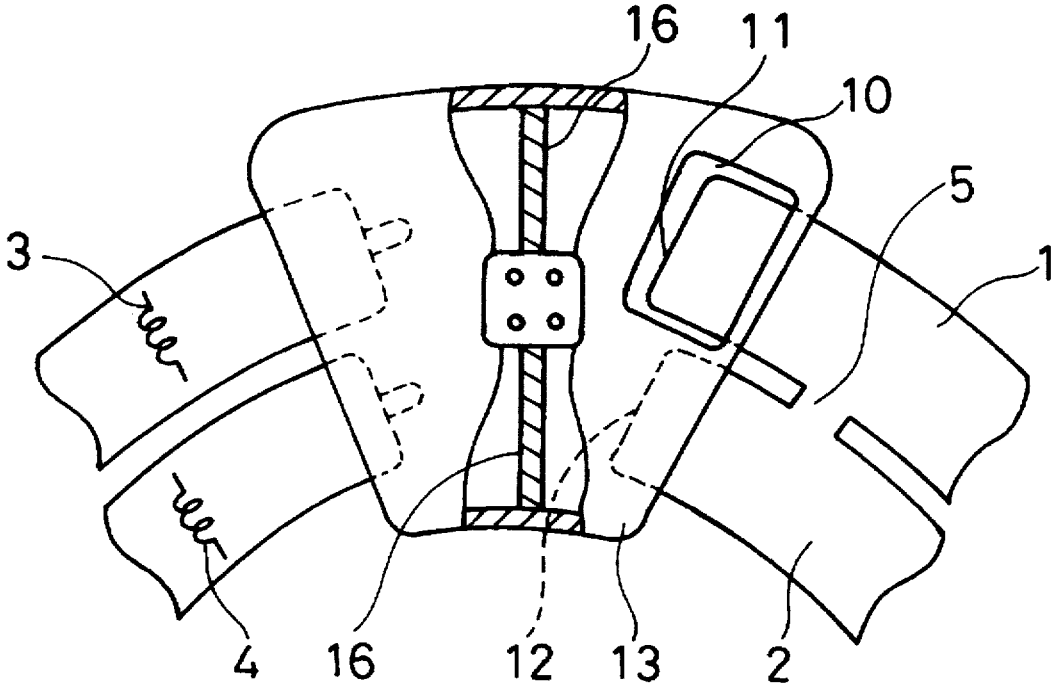
FIG. 9 is a partially cutaway view in elevation to show the structure around the bridge-jointed portion of the circular fluorescent lamp of Example 4 of this invention.

FIG. 9 is a partially cutaway view in elevation to show a structure around the bridge-jointed portion of the circular fluorescent lamp of Example 4 of this invention. As shown in FIG. 9, a lamp base 13 is attached surrounding the tube-end parts of the electrode (3, 4) side and the other tube-end parts (11, 12) of the circular arc tubes (1, 2). The lamp base 13 is formed with a vent 10 and a thermal shielding plate 16. The lamp base 13 allows the tube-end part (the coldest spot) 11 of the outer circular arc tube 1 to be exposed to the open air, and the thermal shielding plate 16 shields the heat between the tube-end parts of the electrodes (3, 4) side and the other tube-end parts (11, 12). The thermal shielding plate 16 controls the transference of heat from the elctrodes (3, 4) to the other tube-end part 11 of the circular arc tube 1 where the coldest spots are formed. Thus it is possible to prevent the temperature of the coldest spot from rising excessively above the best temperature region more securely compared to the case of Example 3. As a result, the lamp lumen output will not be lowered.

EXAMPLE 5

Figure 10:
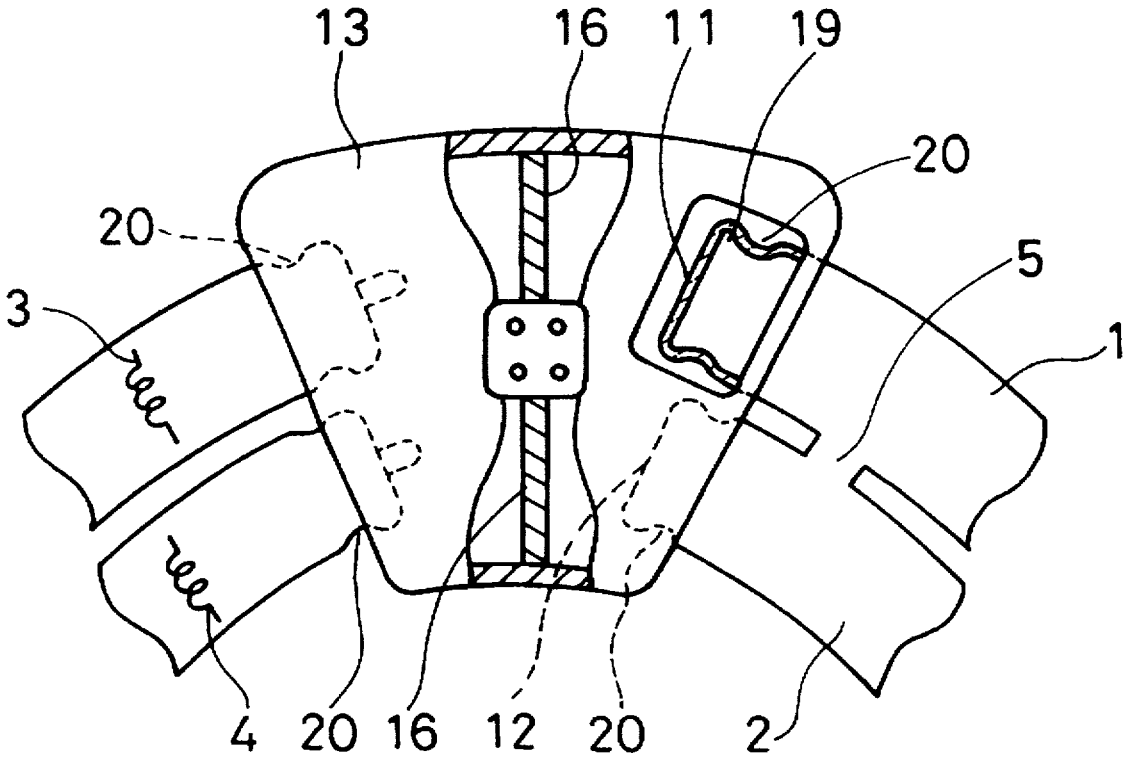
FIG. 10 is a partially cutaway view in elevation to show a structure of the circular fluorescent lamp of Example 5 of this invention.

FIG. 10 is a partially cutaway view in elevation to show a structure around the bridge-jointed portion of the circular fluorescent lamp of Example 5 of this invention. As shown in FIG. 10, holding parts 20 for a bending process are provided at the outer surfaces of the both tube-end parts of the circular arc tubes 1 and 2. And grooves 19 are formed on the inner surfaces of the tips of at least the tube-end parts (11, 12) of the non-electrode side. Other features are the same as those of Example 4 (FIG. 9), so the explanation is omitted. According to this structure, the holding parts 20 for the bending process can be firmly held during the lamp manufacturing process, and thus the accuracy for the bending process of the circular arc tubes (1, 2) will be improved. In addition, coldest spots will be formed at the grooves 19, and the temperature can be kept at the optimum level.

Figure 11:
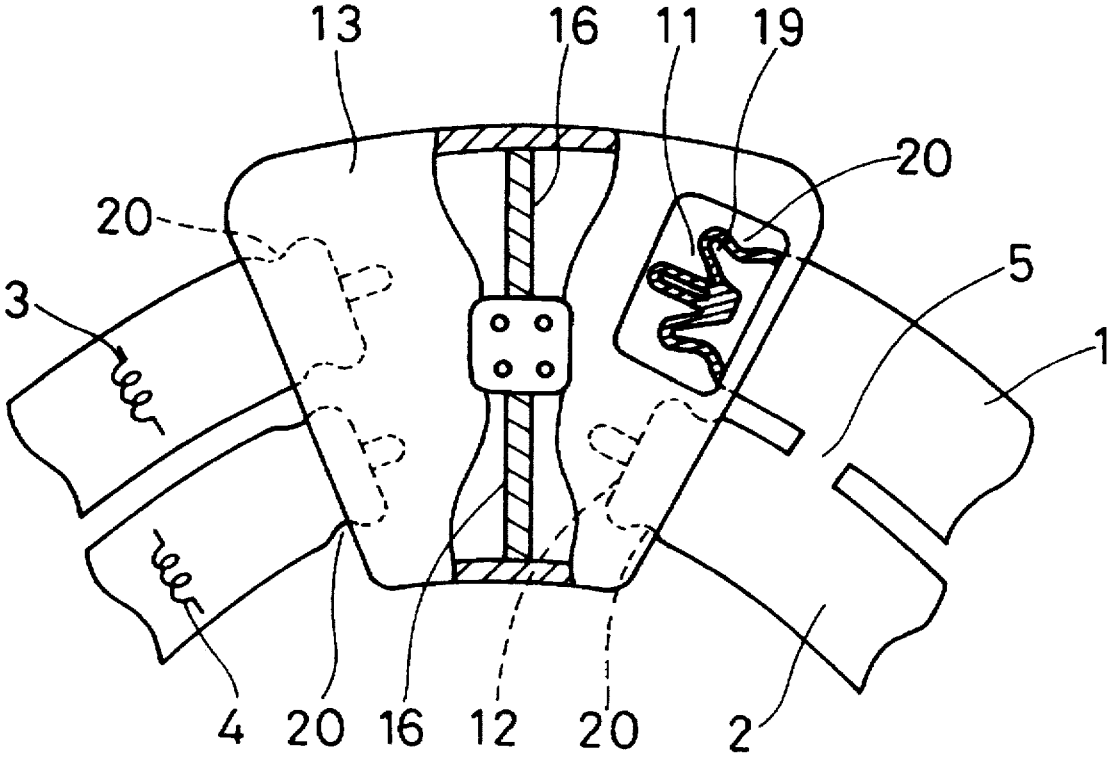
FIG. 11 is a partially cutaway view in elevation to show another structure of the circular fluorescent lamp of Example 5 of this invention.

As shown in FIG. 11, the tube-end parts (11, 12) of the non-electrode side can be sealed with a stem in the same way as the tube-end parts of the electrode side. Thus the strength of the tube-end parts (11, 12) will be improved compared to the case shown in FIG. 10. In FIG. 10, the tube-end parts are formed by partially melting the arc tubes. Therefore, tube-end parts (11, 12) of arc tubes with a larger tube diameter become thinner. On the other hand, if the tube-end parts are sealed with stems, some problems like cracks of the tube-end parts can be prevented during the bending process and after the lamp is completed. In addition, the manufacturing method using stems to seal is relatively simple compared to the case shown in FIG. 10, and thus the tubes can be manufactured using conventional facilities.

EXAMPLE 6

Figure 12:
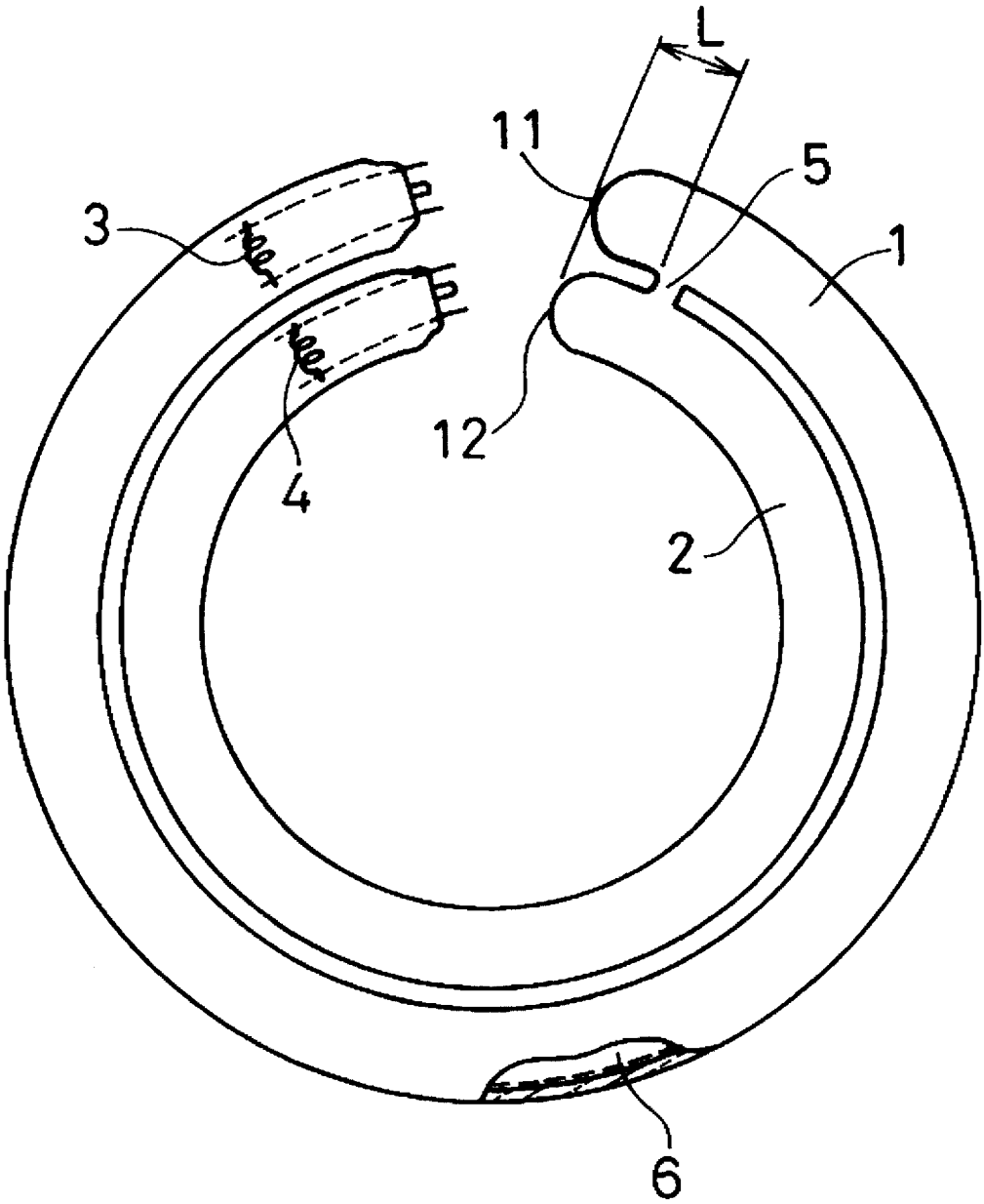
FIG. 12 is a partially cutaway view in elevation of a circular fluorescent lamp of Example 6 of this invention.
Figure 13:
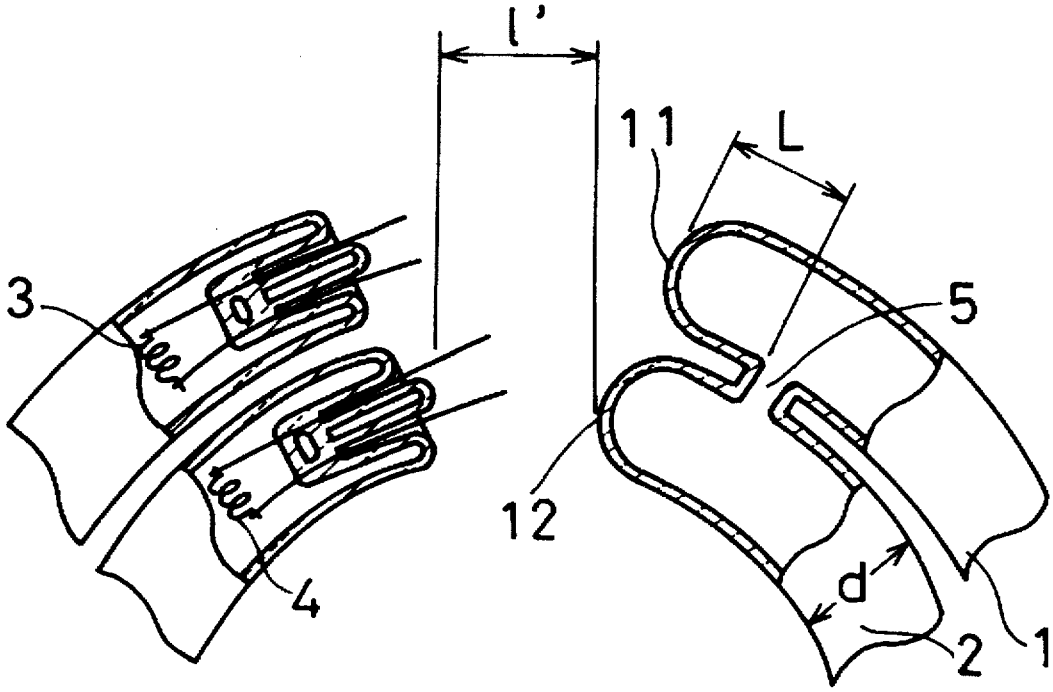
FIG. 13 is a partially cutaway view in elevation to show the structure around the bridge-jointed portion of the circular fluorescent lamp shown in FIG. 12.

FIG. 12 is a partially cutaway view in elevation to show the circular fluorescent lamp of Example 6 of this invention. FIG. 13 is a partially cutaway view in elevation to show the structure around the bridge-jointed portion of the circular fluorescent lamp shown in FIG. 12. FIGS. 12 and 13 show that two glass circular arc tubes (1, 2) are disposed concentrically on the same plane, and electrodes (3, 4) are attached to the tube-end parts of one side of the circular arc tubes (1, 2) respectively. The other tube-end parts (11, 12) of the circular arc tubes (1, 2) are sealed. The circular arc tubes 1 and 2 are joined near the tube-end parts (11, 12) with a glass bridge-jointed portion 5 in order to form a discharge path between the electrodes (3, 4) inside the arc tubes. Rare earth fluorophor 6 is coated on the inner surfaces of the arc tubes (1, 2). Mercury and rare gas (200–500 Pa) as a starting-gas as well as a buffer gas (e.g., argon and neon) are sealed in the tubes. The mercury can be an amalgam like zinc-mercury.

The circular fluorescent lamp of this example has a compact shape, in which the tube outer diameter of the circular arc tubes (1, 2) is 14 mm, the circle outer diameter of the outer circular arc tube 1 is 150 mm, and the circle inner diameter of the inner arc tube 2 is 90 mm. The lamp is designed to light on at 25 W of lamp power input.

L is the distance measured along the center line of each of the tubes (1, 2) from the point corresponding radially to the end part of the bridge-jointed portion 5 to each of the sealed tube-end parts (11, 12). The center distance between the tube-end parts of the inner circular arc tube 2 is represented as l'. L is 13 mm and l' is 18 mm. When the circular fluorescent lamp was lighted up at 25 W using an inverter circuit of 50 kHz, a high lumen output value, namely 1490 lm, with luminous color of 3000 kelvin of color temperature was obtained. Temperatures of the circular arc tubes (1, 2) were measured and the coldest spots were found to be formed on the tube-end parts (11, 12). The temperatures of the coldest spots were 45° C. This corresponds to the best mercury vapor pressure in which almost the maximum lumen output value can be obtained when 25 W is lighted up (when the room temperature is 25° C.). After various examinations, it was found that the distance L should be limited to $0.5d \leqq L \leqq 1.3d$ where the tube outer diameter is represented as d. As a result, the temperature of the coldest spots was kept in a region where the mercury vapor pressure inside the arc tubes is best, and the maximum value of the lamp lumen output was easily obtained.

EXAMPLE 7

This example refers to a circular fluorescent lamp which is identical to the lamp in Example 6 except that a lamp base is attached.

Figure 14:
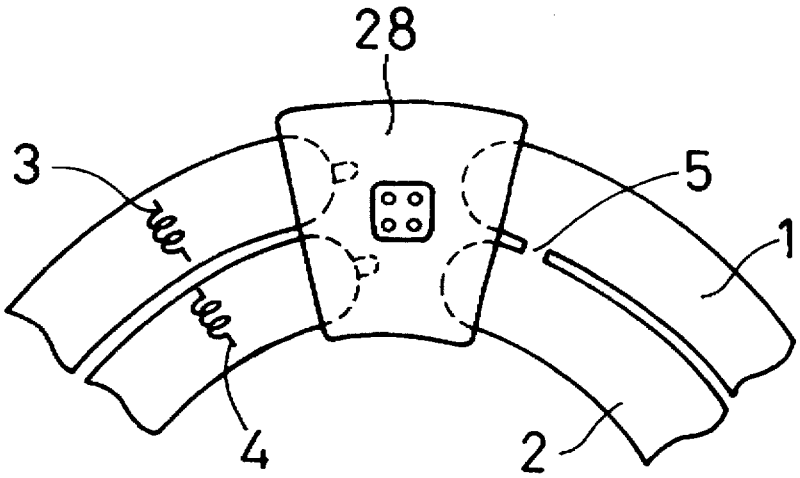
FIG. 14 is an elevational view to show the structure around a circular fluorescent lamp manufactured to be compared with the ones of Examples 7 and 8.

A circular fluorescent lamp shown in FIG. 14 was manufactured in which the whole tube-end parts of the circular arc tubes (1, 2) are surrounded by a conventional lamp base 28, and the characteristics were measured. And it was found that the lumen output value of this lamp was 1260 lm, while that value of a naked lamp without a lamp base is 1490 lm. In other words, the lamp lumen output was excessively lowered, because the temperature of the coldest spots, and thus the mercury vapor pressure, rose excessively from the best region.

Figure 15:
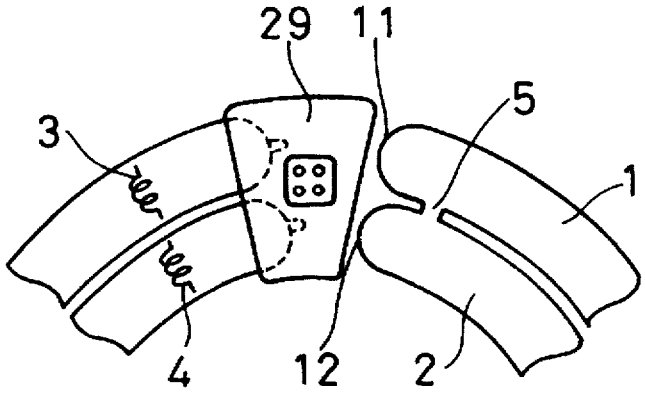
FIG. 15 is an elevational view to show a structure around the bridge-jointed portion of the circular fluorescent lamp of Example 7 of this invention.
Figure 16:
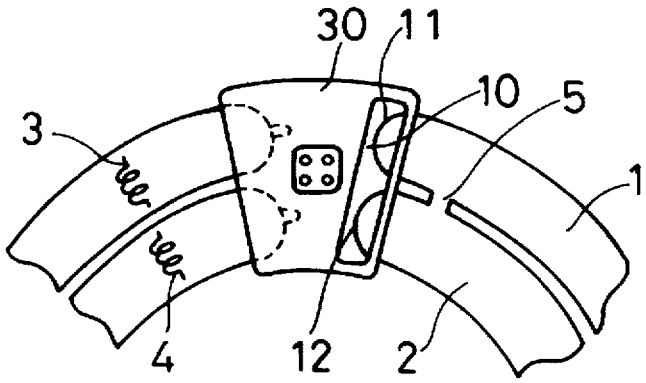
FIG. 16 is an elevational view to show another structure around the bridge-jointed portion of the circular fluorescent lamp of Example 7 of this invention.

Based on the result, two types of circular fluorescent lamps were manufactured. A lamp in FIG. 15 has a lamp base 29 which is surrounding the tube-end parts of the electrodes (3, 4) side of the circular arc tubes (1, 2), while the other tube-end parts (the coldest spots) 11 and 12 are separated from the lamp base 29 and exposed to the open air. Another lamp in FIG. 16 has a lamp base 30 which is surrounding the tube-end parts of the electrodes (3, 4) side and the tube-end parts (11, 12) of the other side of the circular arc tube (1, 2), and the tube-end parts (11, 12) are exposed to the open air through a vent 10 formed on the lamp base 30. The lamp lumen output value of the lamp shown in FIG. 15 was 1575 lm, and the lamp lumen output value of the lamp shown in FIG. 16 was 1520 lm. Both values were approximate to that of a naked lamp without a lamp base. In other words, the lamp lumen output was not lowered so much, since the heat of the electrodes (3, 4) was not transferred to the tube-end parts (11, 12), so the temperature of the coldest spots did not rise excessively from the best temperature region.

EXAMPLE 8

This example refers to a circular fluorescent lamp with the rated electric power of 60 W.

The structure of the circular fluorescent lamp of this example is basically as same as that of Example 6 (see FIGS. 12 and 13). And the circular fluorescent lamp of this example has a lamp base 29 which is surrounding the tube-end parts of the electrodes (3, 4) side of the circular arc tubes (1, 2), while the other tube-end parts (the coldest spots) 11, 12 are separated from the lamp base 29 to be exposed to the open air (see FIG. 15).

The tube outer diameter of the circular arc tubes (1, 2) is 20 mm, the circle outer diameter of the outer circular arc tube 1 is 240 mm, circle inner diameter of the inner circular arc tube 2 is 155 mm, the distance L measured along the center line of each of the tubes (1, 2) from the point corresponding radially to the end part of the bridge-jointed portion 5 to each of the sealed tube-end parts (11, 12) is 19 mm, and the center distance l of the both tube-end parts of the circular arc tube 2 is 22 mm. When this lamp was lighted up with a lamp input of 60 W using an inverter circuit of 50 kHz, a high lamp lumen output, namely 4390 lm, was obtained.

Figure 17:
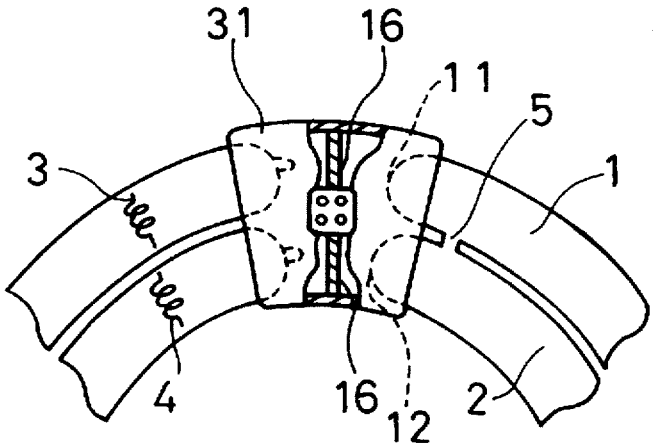
FIG. 17 is a partially cutaway view in elevation to show a structure around the bridge-jointed portion of the circular fluorescent lamp of Example 8 of this invention.

A conventional lamp base 28 shown in FIG. 14 was used for the circular fluorescent lamp of this example, and further consideration was given to the structure of the lamp base 28 surrounding the whole tube-end parts of the circular arc tubes 1 and 2. Even if the whole tube-end parts of the tubes are surrounded by the lamp base, it is possible to prevent the temperature of the coldest spots from rising excessively from the best region. For this purpose, a lamp base which is formed with a thermal shielding plate 16 made of a thermal shielding part to shield the electrode side from the other tube-end parts is used. (see FIG. 17). Then, the transference of heat from the tube-end parts of the electrode (3, 4) side to the coldest spots (the other tube-end parts 11, 12) is controlled, and the lamp lumen output is not lowered. Specifically, the lamp lumen output value was 1260 lm when the lamp base 28 of FIG. 13 was used, while the value was 1420 lm when the lamp base 31 with the thermal shielding plane 16 was used. A similar thermal shielding effect was obtained when the lamp base 30 with the vent 16 of FIG. 16 was used. Specifically, the lamp lumen output value was 1520 lm as mentioned above when the lamp base 30 with only the vent 10 was used. But the value was 1560 lm (40 lm higher) when a thermal shielding plate was further provided.

EXAMPLE 9

Figure 18:
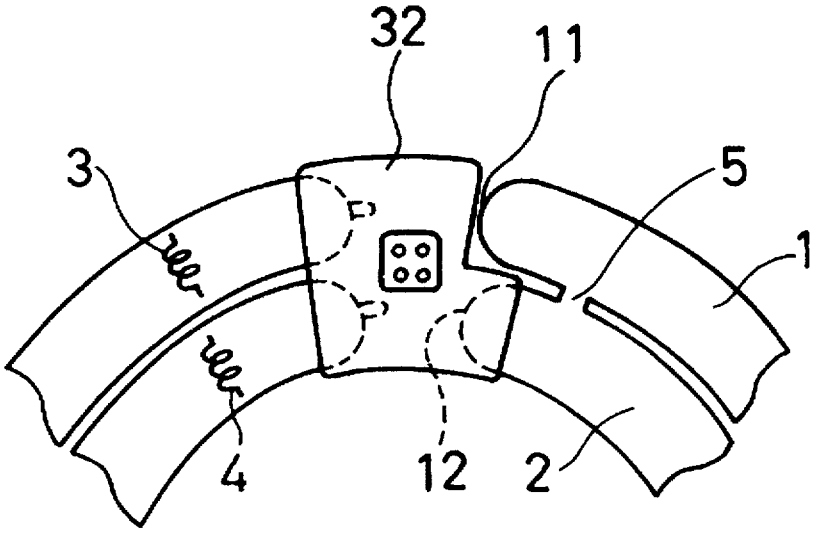
FIG. 18 is an elevational view to show a structure around the bridge-jointed portion of the circular fluorescent lamp of Example 9 of this invention.
Figure 19:
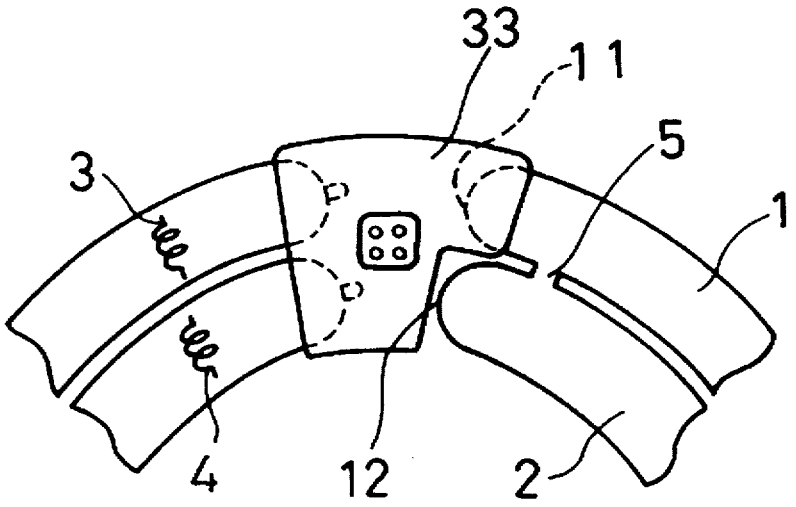
FIG. 19 is an elevational view to show another structure around the bridge-jointed portion of the circular fluorescent lamp of Example 9 of this invention.

FIG. 18 is an elevational view to show a structure around the bridge-jointed portion of the circular fluorescent lamp of Example 9 of this invention. FIG. 19 is an elevational view to show another structure around the bridge-jointed portion of the circular fluorescent lamp of Example 9 of this invention.

In this example, as shown in FIGS. 18 and 19, circular fluorescent lamps having lamp bases (32, 33) respectively were manufactured. Either tube-end part 11 or 12 of the circular arc tubes 1 is exposed to the open air from the lamp base 32 or 33, and a coldest spot was formed on the exposed tube-end part (11 or 12). The lamp lumen output of this example was as same as that of the tubes with the lamp base 29 shown in FIG. 15. Preferably, the coldest spot is formed at the tube-end part 11 of the outer circular arc tube 1 as shown in FIG. 18, since the non-luminous area becomes smaller and a higher lamp lumen output value can be obtained.

EXAMPLE 10

Figure 20:
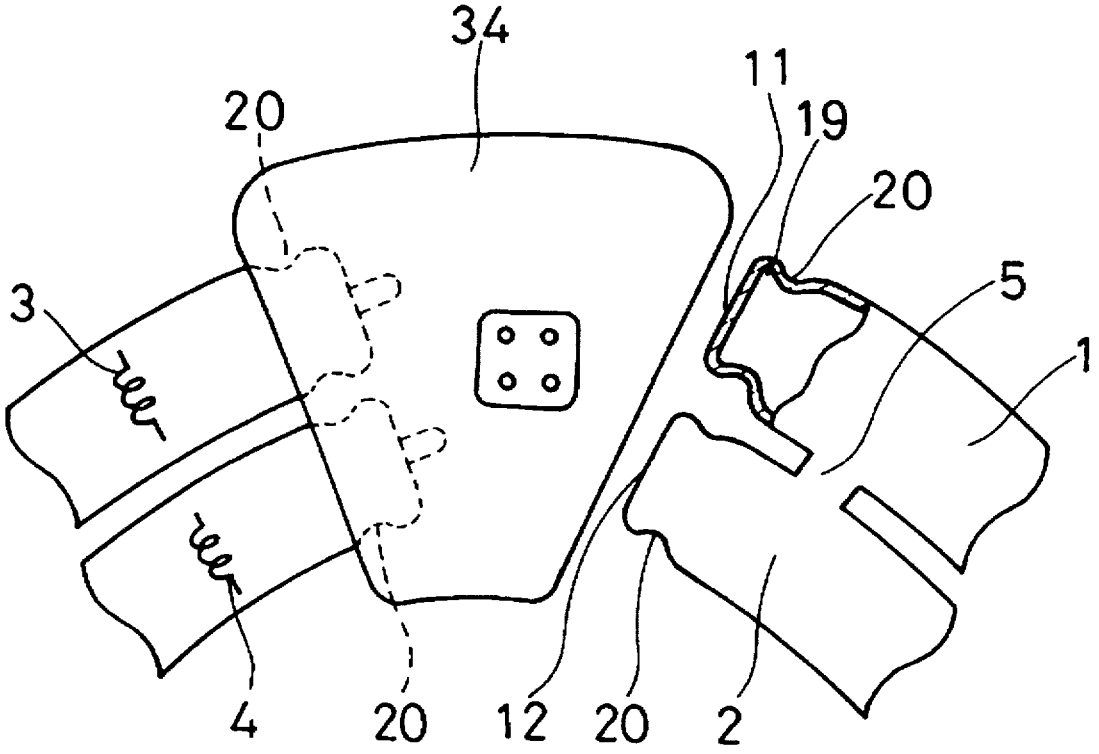
FIG. 20 is a partially cutaway view in elevation to show a structure of the circular fluorescent lamp of Example 10 of this invention.

FIG. 20 is a partially cutaway view in elevation to show a structure around the bridge-joint portion of the circular fluorescent lamp of Example 10 of this invention. As shown in FIG. 20, holding parts (20) for a bending process are provided on the outer surfaces of the both tube-end parts of the circular arc tubes 1 and 2. And grooves 19 are formed on the inner surfaces of the tips of at least the tube-end parts (11, 12) of the non-electrode side of the tubes 1 and 2. The tube-end parts of the electrodes (3, 4) side of the circular arc tubes (1, 2) are surrounded with a lamp base 34, while the other tube-end parts (11, 12) are separated from the lamp base 34 and exposed to the open air. According to this example, the holding parts 20 for the bending process can be held securely during the manufacturing process, and thus the accuracy for bending process is improved. In addition, coldest spots are formed at the grooves 19, and the temperature can be kept at the best value.

Figure 21:
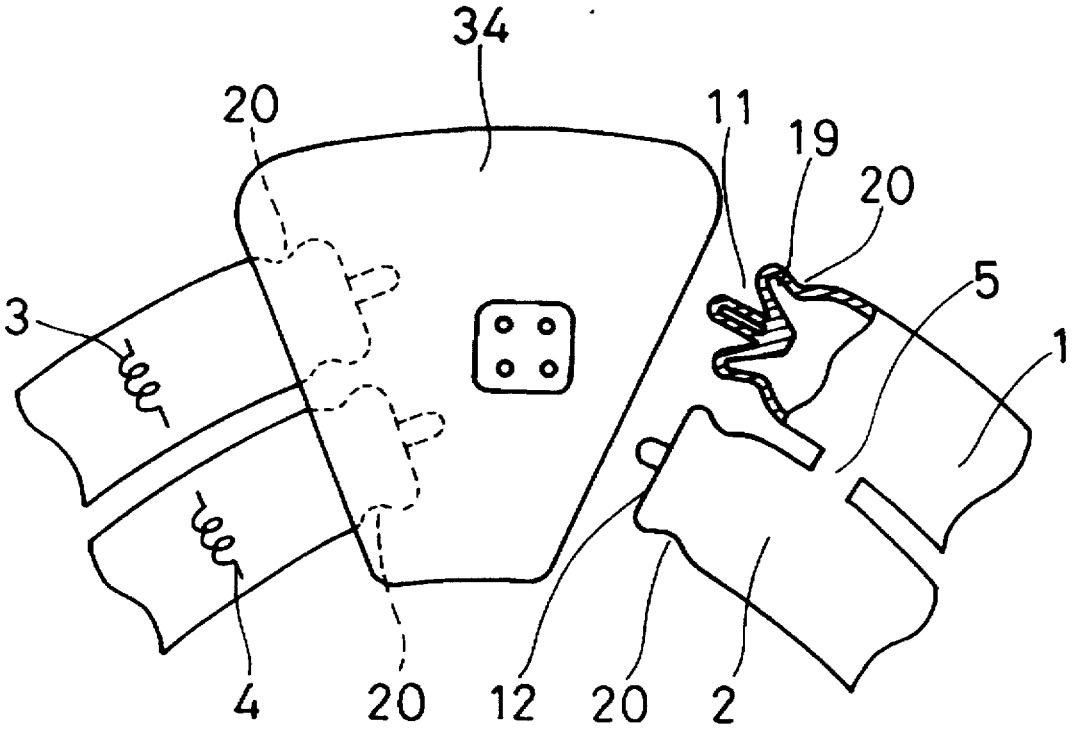
FIG. 21 is a partially cutaway view in elevation to show another structure of the circular fluorescent lamp of Example 10 of this invention.

As shown in FIG. 21, the tube-end parts (11, 12) of the non-electrode side can be sealed with a stem in the same way as the tube-end parts of the electrode side. Thus the strength of the tube-end parts (11, 12) will be improved compared to the case shown in FIG. 20. In FIG. 20, the tube-end parts are formed by partially melting the arc tubes. Therefore, tube-end parts (11, 12) of arc tubes with a larger tube diameter become thinner. On the other hand, if the tube-end parts are sealed with stems, some problems like cracks of the tube-end parts can be prevented during the bending process and after the lamp is completed. In addition, the manufacturing method using stems to seal is relatively simple compared to the case shown in FIG. 20, and thus the tubes can be manufactured using conventional facilities.

In this example, the lamp base 34 surrounds only the tube-end parts of one side of the circular arc tubes 1 and 2. However, this example does not limit the structure of the lamp base, so any lamp base with at least tube-end parts (11, 12) exposed to the open air can be used.

EXAMPLE 11

Figure 22:
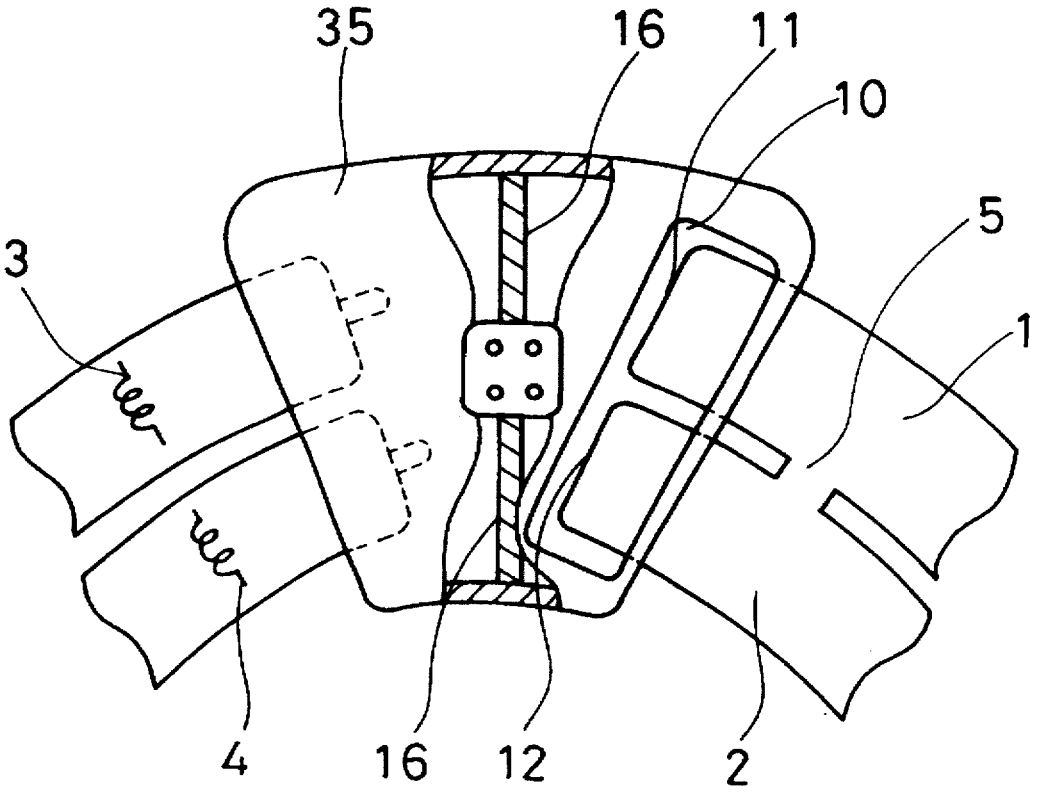
FIG. 22 is a partially cutaway view in elevation to show a structure of the circular fluorescent lamp of Example 11 of this invention.

FIG. 22 is a partially cutaway view in elevation to show a structure around the bridge-jointed portion of the circular fluorescent lamp of Example 11 of this invention. As shown in FIG. 22, a lamp base 35 is provided to surround the tube-end parts of the electrodes (3, 4) side and the coldest spots of the tube-end parts (11, 12) of the non-electrode side. And a vent 10 and a thermal shielding plate 16 are provided for the lamp base 35. The vent 10 allows the coldest spot to be exposed to the open air, and the thermal shielding plate 16 shielded the heat between the tube-end parts of the electrode (3, 4) side and the other tube-end parts (11, 12). According to this structure, it is possible to prevent the temperature of the coldest spots from excessively rising from the best temperature region, because of the synergistic effect of the vent 10 and the thermal shielding plate 16. As a result, the lamp lumen output will not be lowered.

EXAMPLE 12

Figure 23:
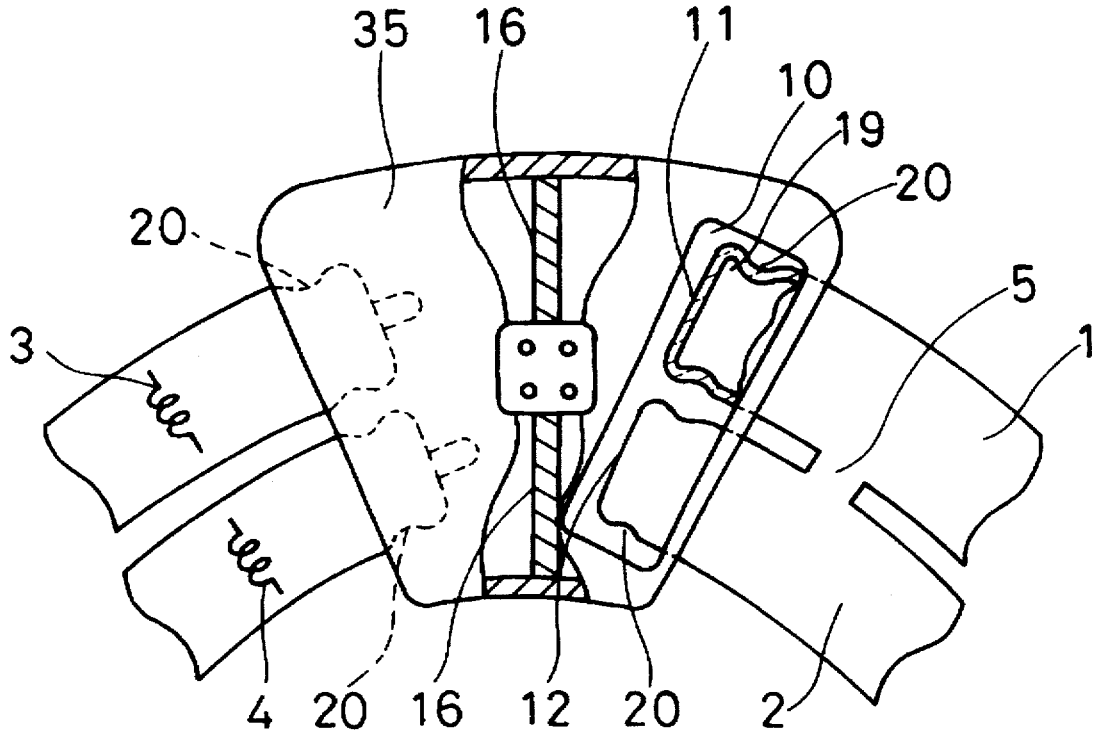
FIG. 23 is a partially cutaway view in elevation to show a structure of the circular fluorescent lamp of Example 12 of this invention.

FIG. 23 is a partially cutaway view in elevation to show a structure around the bridge-jointed portion of the circular fluorescent lamp of Example 12 of this invention. As shown in FIG. 20, holding parts 20 for bending process are provided to the outer surfaces of the both tube-end parts of the circular arc tubes 1 and 2. And grooves 19 are formed on the inner surfaces of the tips of at least the tube-end parts (11, 12) of the non-electrode side of the tubes 1 and 2. Other features are the same as those of Example 11 (FIG. 22), so the explanation is omitted. According to this example, coldest spots are formed on the grooves 19 and the temperature is kept at the best value. Thus it is possible to prevent temperature rise of the coldest spots more securely compared to the case of Example 11. Also, in this example, the holding parts 20 for bending process can be held during the manufacturing process, and thus the accuracy for the bending process is improved.

Figure 24:
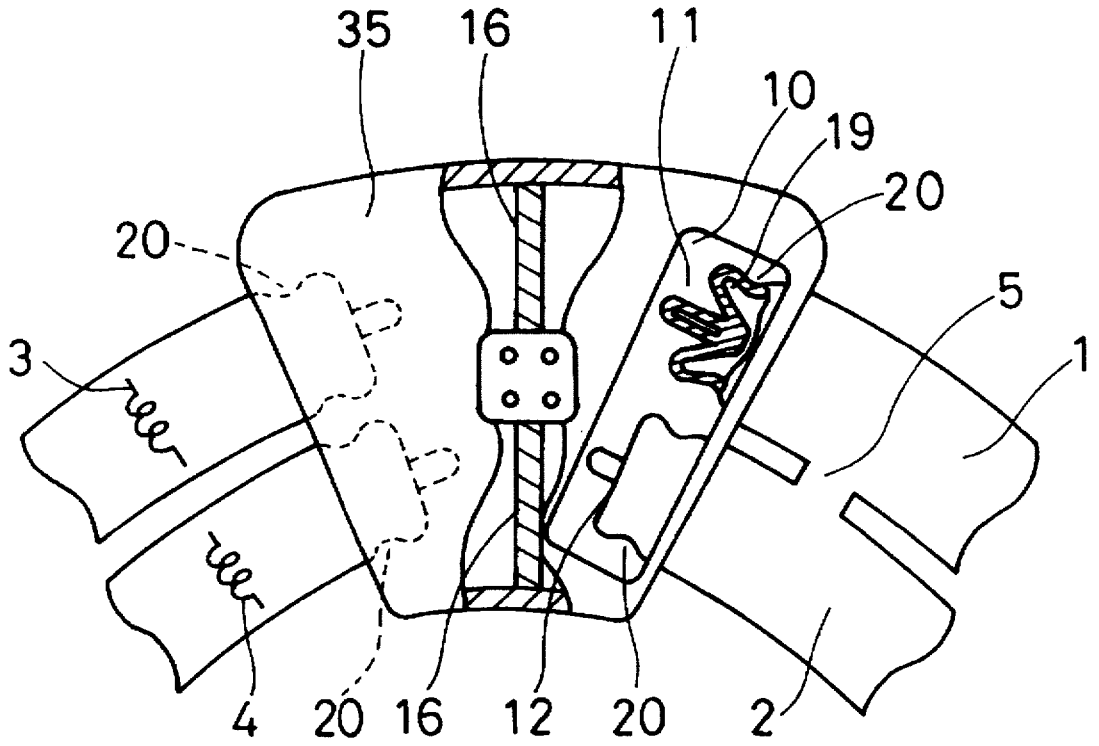
FIG. 24 is a partially cutaway view in elevation to show another structure of the circular fluorescent lamp of Example 12 of this invention.

As shown in FIG. 24, if the tube-end parts (11, 12) of the non-electrode side are sealed with stems in the same way as the tube-end parts of the electrode side, the strength of the tube-end parts (11, 12) will be improved compared to the case shown in FIG. 23. In FIG. 23, the tube-end parts are formed by partially melting the arc tubes. Therefore, tube-end parts (11, 12) of arc tubes with a larger tube diameter become thinner. On the other hand, if the tube-end parts are sealed with stems, some problems like cracks of the tube-end parts can be prevented during the bending process and after the lamp is completed. In addition, the manufacturing method using stems to seal is relatively simple compared to the case shown in FIG. 23, and thus the tubes can be manufactured using conventional facilities.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A circular fluorescent lamp which has plural circular arc tubes disposed concentrically, with a first circular arc tube being disposed outwardly of a second circular arc tube, each of the tubes having an electrode at one tube-end part and a sealed portion at the other tube-end part, and the tubes are joined near the sealed portion with a bridge-jointed portion to form a discharge path inside the tubes, wherein a distance $L_1$(mm) is measured along a center line of the first tube from the point corresponding radially to the end part of the bridge-jointed portion to the sealed tube-end part of the first tube while a distance $L_2$(mm) is measured along a center line of the second tube from the point corresponding radially to the end part of the bridge-jointed portion to the sealed tube-end part of the second tube, and $L_1$ is longer than $L_2$.

2. The circular fluorescent lamp according to claim 1, wherein the plural circular arc tubes are disposed on the same plane.

3. The circular fluorescent lamp according to claim 1, wherein $L_1 \geqq 1.3L_2$ holds true.

4. The circular fluorescent lamp according to claim 1, wherein the tube-end part of the electrode side of the first circular arc tube is longer than that of the second circular arc tube.

5. The circular fluorescent lamp according to claim 1, wherein the configurations of the tips of the bridge-jointed portions are essentially symmetric to the center axis of the circular arc tubes.

6. The circular fluorescent lamp according to claim 1, wherein holding parts for a bending process are provided at the outer surfaces of the both tube-end parts of the circular arc tubes.

7. The circular fluorescent lamp according to claim 6, wherein grooves are formed on at least the inner surfaces of the tips of the non-electrode sides of the tubes.

8. The circular fluorescent lamp according to claim 1, wherein a lamp base is provided to surround the tube-end parts of the electrode side of the circular arc tubes.

9. The circular fluorescent lamp according to claim 1, wherein a lamp base is provided to surround the both tube-end parts of the circular arc tubes while the tube-end parts of the non-electrode side of the first arc tube are exposed to open air.

10. The circular fluorescent lamp according to claim 9, wherein a thermal shielding part is provided for the lamp base in order to shield the heat between the tube-end parts of the electrode side and the tube-end parts of the non-electrode side.

11. The circular fluorescent lamp according to claim 1, wherein the tube-end parts of the non-electrode side of the circular arc tubes are sealed with stems.

12. A circular fluorescent lamp which has plural circular arc tubes disposed concentrically, with a first circular arc tube being disposed outwardly of a second circular arc tube, and each of the tubes has an electrode at one tube-end part and a sealed portion at the other tube-end part, and the tubes are joined near the sealed portions with a bridge-jointed portion to form one discharge path inside the tubes, and coldest spots are formed at the tube-end parts on the non-electrode side, wherein when a distance L(mm) is measured along a center line of one of the tubes from a point corresponding radially to the end part of the bridge-jointed portion to the sealed tube-end part, and an outer diameter of said one of the tubes is d(mm), $0.5d \leqq L \leqq 1.3d$ holds true.

13. The circular fluorescent lamp according to claim 12, wherein the plural arc tubes are disposed on the same plane.

14. The circular fluorescent lamp according to claim 12, wherein holding parts for a bending process are provided at the outer surfaces of the both tube-end parts of the circular arc tubes.

15. The circular fluorescent lamp according to claim 14, wherein grooves are formed at least at the inner surfaces of the tips of the non-electrode sides of the tubes.

16. The circular fluorescent lamp according to claim 12, wherein the non-electrode tube-end parts of the circular arc tubes are sealed with stems.

17. A circular fluorescent lamp which has plural arc tubes disposed concentrically, with a first circular arc tube being disposed outwardly of a second circular arc tube, and each of the tubes has an electrode at one tube-end part and a sealed portion at the other tube-end part, and the tubes are joined near the sealed portion with a bridge-jointed portion to form one discharge path inside the tubes, and coldest spots are formed at the tube-end parts on the non-electrode side, and the circular fluorescent lamp is also provided with a lamp base which surrounds at least one side of the both tube-end parts, and the coldest spots are exposed to open air.

18. The circular fluorescent lamp according to claim 17, wherein the plural circular arc tubes are disposed on the same plane.

19. The circular fluorescent lamp according to claim 17, wherein when a distance L(mm) is measured along a center line of one of the tubes from a point corresponding radially to the end part of the bridge-jointed portion to the sealed tube-end part and an outer diameter of said one of the tubes is d(mm), $0.5d \leqq L \leqq 1.3d$ holds true.

20. The circular fluorescent lamp according to claim 17, wherein the lamp base is separated from the coldest spots of the non-electrode side.

21. The circular fluorescent lamp according to claim 17, wherein the lamp base surrounds the tube-end parts of the electrode side and the coldest spots of the other tube-end parts, and a vent is provided on the lamp base so that the coldest spots are exposed to open air.

22. The circular fluorescent lamp according to claim 17, wherein a coldest spot is formed in the first circular arc tube.

23. The circular fluorescent lamp according to claim 17, wherein holding parts for a bending process are provided at the outer surfaces of the both end parts of the circular arc tubes.

24. The circular fluorescent lamp according to claim 23, wherein grooves are formed on the inner surfaces of the tips of the non-electrode sides of the tubes.

25. The circular fluorescent lamp according to claim 17, wherein the end parts of the non-electrode side are sealed with stems.

26. A circular fluorescent lamp which has plural circular arc tubes disposed concentrically, with a first circular arc tube being disposed outwardly of a second circular arc tube, and each of the tubes has an electrode at one tube-end part and a sealed portion at the other tube-end part, and the tubes are joined near the tube-end parts of the non-electrode side with a bridge-jointed portion to form a discharge path inside the tubes, while coldest spots are formed at the tube-end parts on the non-electrode side and a lamp base is provided to surround at least one side of the both tube-end parts, and a thermal shielding part is also provided for the lamp base in order to shield the heat between the tube-end parts of the electrode side and those of the non-electrode side.

27. The circular fluorescent lamp according to claim 26, wherein the plural circular arc tubes are disposed on the same plane.

28. The circular fluorescent lamp according to claim 26, wherein when a distance L(mm) is measured along a center line of one of the tubes from a point corresponding radially to the end part of the bridge-jointed portion to the sealed tube-end part and an outer diameter of said one of the tubes is d(mm), $0.5d \leqq L \leqq 1.3d$ holds true.

29. The circular fluorescent lamp according to claim 26, wherein a lamp base is provided to surround the tube-end parts of the electrode side and the coldest spots of the other tube-end parts, and a vent is formed on the lamp base so that the coldest spots are exposed to open air.

30. The circular fluorescent lamp according to claim 26, wherein holding parts for bending process are provided to the outer surfaces of the both end parts of the circular arc tubes.

31. The circular fluorescent lamp according to claim 30, wherein grooves are formed at least at the inner surface of the tips of the non-electrode side.

32. The circular fluorescent lamp according to claim 26, wherein the tube-end parts of the non-electrode side of the circular arc tubes are sealed with stems.

* * * * *